US010397675B2

(12) United States Patent
Xiang et al.

(10) Patent No.: US 10,397,675 B2
(45) Date of Patent: Aug. 27, 2019

(54) DUST PROTECTION FOR EXTERNALLY PORTED SPEAKER ENCLOSURE

(71) Applicant: Harman International Industries, Incorporated, Stamford, CT (US)

(72) Inventors: Henry Xiang, Suzhou (CN); Quentine Ruan, SIP Suzhou (CN); Sum Zhang, Suzhou (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/715,379

(22) Filed: Sep. 26, 2017

(65) Prior Publication Data

US 2019/0098384 A1 Mar. 28, 2019

(51) Int. Cl.

| | |
|---|---|
| ***H04R 9/06*** | (2006.01) |
| ***H04R 1/02*** | (2006.01) |
| ***H04R 1/28*** | (2006.01) |
| *H04R 1/34* | (2006.01) |

(52) U.S. Cl.

CPC ..... *H04R 1/023* (2013.01); *H04R 1/025* (2013.01); *H04R 1/2826* (2013.01); *H04R 1/345* (2013.01)

(58) Field of Classification Search

CPC ..... H04R 1/02; H04R 1/021; H04R 1/023; H04R 1/025; H04R 1/026; H04R 1/028; H04R 1/2823; H04R 1/2826; H04R 1/2842; H04R 1/2846; H04R 1/2849; H04R 1/2853; H04R 1/2857; H04R 1/086

USPC ..... 381/391, 359, 332; 181/210; 455/575.1, 455/128, 347, FOR. 232

See application file for complete search history.

(56) References Cited

U.S. PATENT DOCUMENTS

| | | | | |
|---|---|---|---|---|
| 4,032,725 | A * | 6/1977 | McGee | H04R 1/025 248/27.1 |
| 5,004,105 | A * | 4/1991 | Freadman | A45C 7/0027 206/320 |
| 5,185,804 | A * | 2/1993 | Watanabe | H04B 1/082 192/95 |
| 5,400,413 | A * | 3/1995 | Kindel | H04R 1/023 181/199 |
| 5,652,413 | A | 7/1997 | Mulera | |
| 10,028,042 | B1 * | 7/2018 | Liao | H04R 1/023 |
| 2010/0272308 | A1 * | 10/2010 | Yamaguchi | B60R 11/0217 381/389 |
| 2014/0233786 | A1 * | 8/2014 | Sumitani | H04R 1/02 381/391 |

FOREIGN PATENT DOCUMENTS

| | | | |
|---|---|---|---|
| EP | 2603017 | A2 | 6/2013 |
| JP | S59108390 | U | 7/1984 |
| JP | 2004088224 | A | 3/2004 |
| WO | 2016155327 | A1 | 10/2016 |

* cited by examiner

*Primary Examiner* — Leshui Zhang

(74) *Attorney, Agent, or Firm* — Angela M. Brunetti

(57) ABSTRACT

An externally coupled speaker assembly having a horizontal ledge extending along a top side of a housing having an opening therein. A screen is positioned at the opening of the housing. A horizontal portion of the screen is retained between a bottom surface of a speaker and the horizontal ledge of the housing. A vertical portion of the screen is retained in a channel approximate to the opening of the housing.

16 Claims, 5 Drawing Sheets

DUST PROTECTION FOR EXTERNALLY PORTED SPEAKER ENCLOSURE

TECHNICAL FIELD

The inventive subject matter is directed to a speaker enclosure having an external port and more particularly to dust protection for a speaker enclosure having an external port.

BACKGROUND

A speaker enclosure having an external port may be implemented to improve speaker performance and produce an acoustically pleasing sound for a listener. Such speaker enclosures may be part of a speaker that is installed in a professional, home or automotive setting. The external port in the speaker enclosure may introduce a potential for dust particles or other undesirable contaminants to enter the speaker enclosure and possibly damage fragile internal workings of the speaker driver, such as a fragile sub-woofer component. This is particularly true for externally ported speaker enclosures installed in an automotive setting, where the speaker enclosure may be exposed to harsh environmental and road conditions. To adequately protect the internal workings of the speaker driver in a speaker enclosure that is externally ported, a screen is typically included in the speaker construction. The screen is placed between a port, or opening in the speaker enclosure and the internal workings of the speaker driver and is typically assembled with a seal or gasket and held in place using multiple fasteners.

There is a need for an improved solution to protect an externally coupled speaker enclosure from potential effects of exposure.

SUMMARY

An externally coupled speaker assembly having a horizontal ledge extending along a top side of a housing having an opening therein. A screen is positioned at the opening of the housing. A horizontal portion of the screen is retained between a bottom surface of a speaker and the horizontal ledge of the housing. A vertical portion of the screen is retained in a channel approximate to the opening of the housing.

Elements and steps in the figures are illustrated for simplicity and clarity and have not necessarily been rendered according to any particular sequence. For example, steps that may be performed concurrently or in different order are illustrated in the figures to help to improve understanding of embodiments of the inventive subject matter.

DESCRIPTION OF INVENTION

While various aspects of the inventive subject matter are described with reference to a particular illustrative embodiment, the inventive subject matter is not limited to such embodiments, and additional modifications, applications, and embodiments may be implemented without departing from the inventive subject matter. In the figures, like reference numbers will be used to illustrate the same components. Those skilled in the art will recognize that the various components set forth herein may be altered without varying from the scope of the inventive subject matter.

Figure 1:
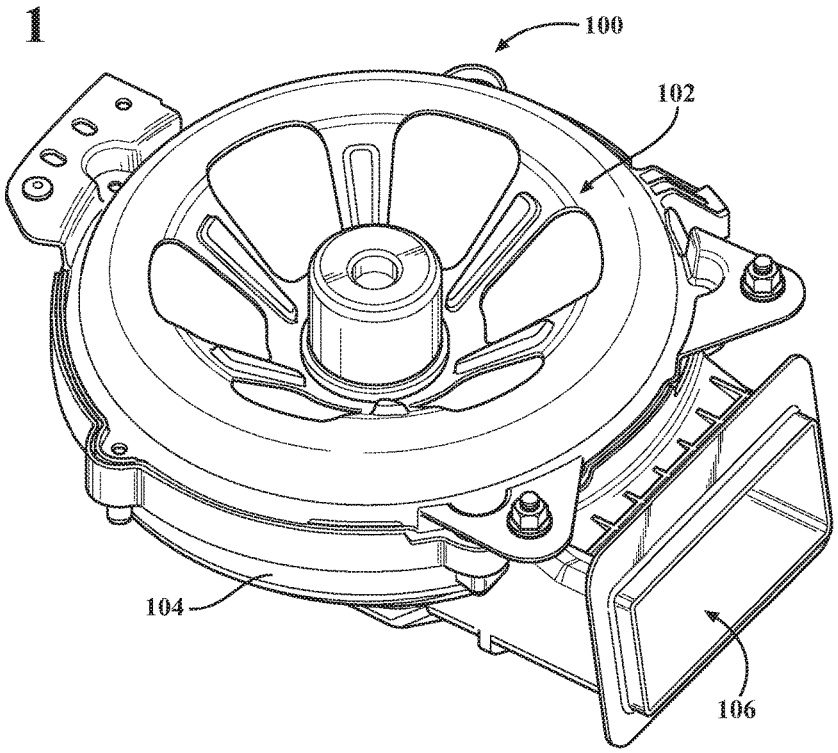
FIG. 1 is a perspective view of an externally coupled speaker assembly.
Figure 2:
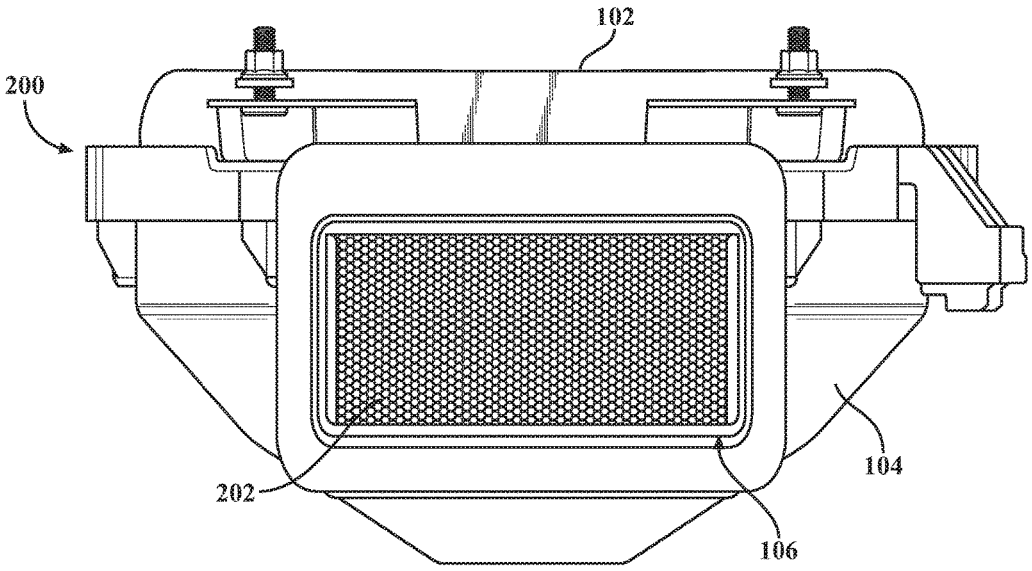
FIG. 2 is an end view of an externally coupled speaker assembly.

FIG. 1 is a perspective view of a speaker assembly 100 having a speaker 102 and a housing 104. The housing 104 has an opening 106 that externally couples the speaker 102 such as, for example, in an automotive application. The opening 106 externally couples the speaker, such as through a door panel or other vehicle structure (not shown). FIG. 2 is an end view 200 of the speaker assembly 100. The opening 106 has a screen 202 disposed in the housing 104 and secured by the speaker 102.

Figure 3:
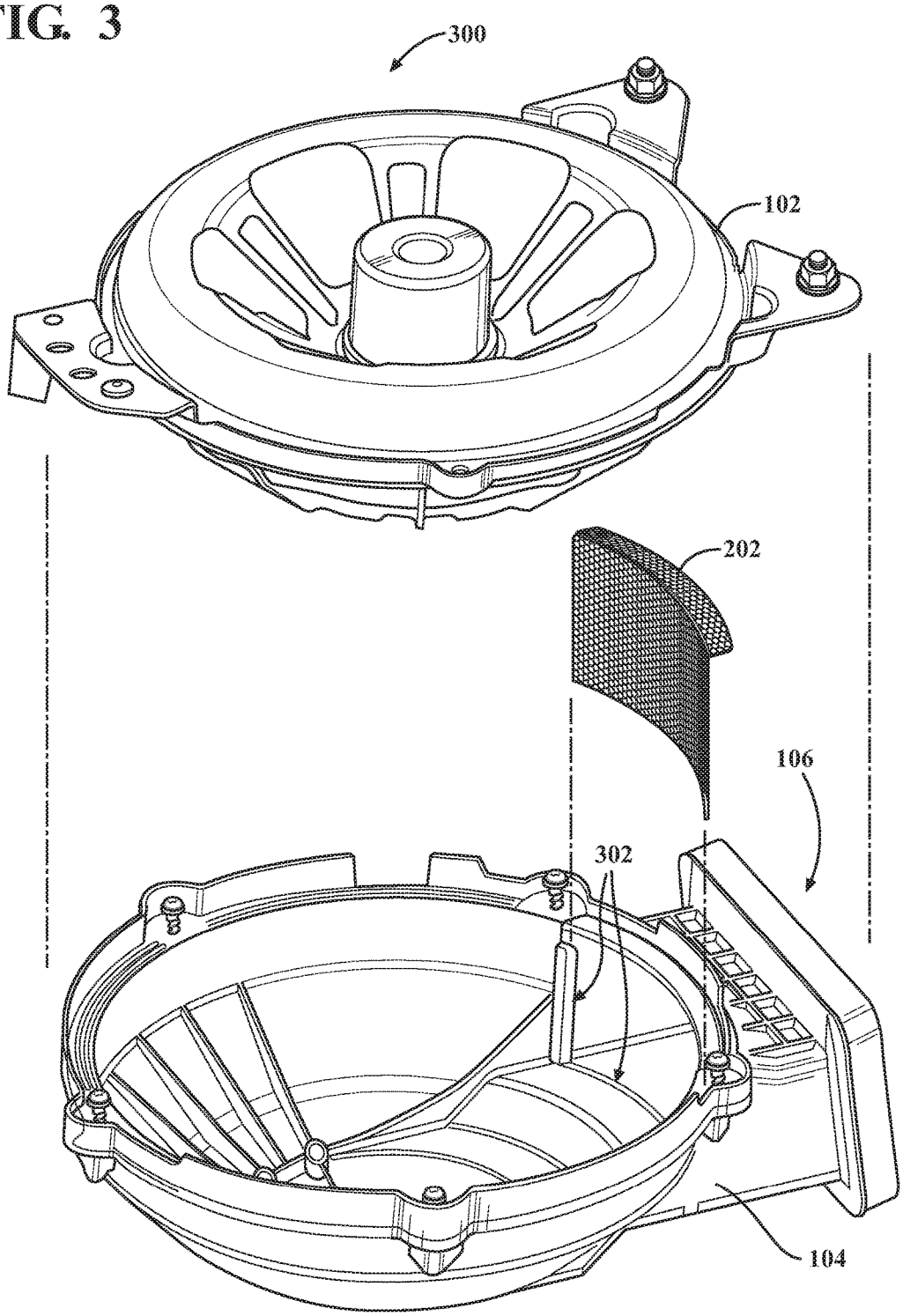
FIG. 3 is an exploded view of an externally coupled speaker assembly.

FIG. 3 is an exploded view 300 of the speaker assembly. A channel 302 is configured in the housing 104 to receive the screen 202. The channel retains the screen 202 on three sides, each vertical side and a bottom side of the screen 202. A surface of the screen 202 is perforated so that particles or contaminants are prevented from entering the housing 104 through the opening 106 that exposes the externally coupled outside of the speaker environment, such as through a door panel or other structure in an automotive example of an externally coupled speaker assembly 100.

Figure 4:
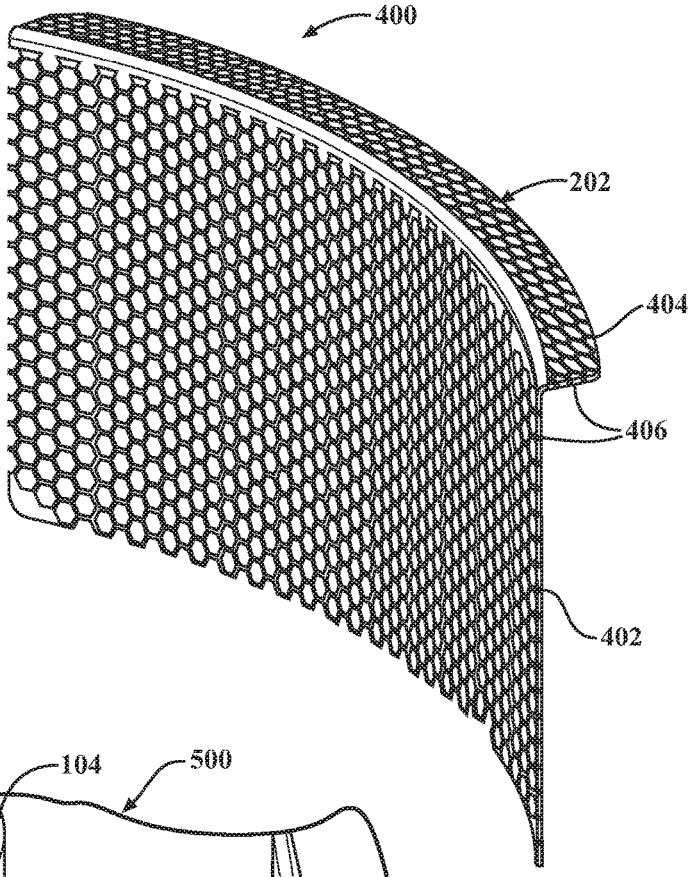
FIG. 4 is a perspective view of a screen.

FIG. 4 is a perspective view 400 of the screen 202. The perforations of the screen 202 have a predetermined size, predetermined shape and predetermined arrangement to prevent undesired particles and contaminants from entering the housing (not shown). The size, shape and arrangement, such as density, pattern and shape, of the perforations on the screen 202 may depend on the application of the externally coupled speaker assembly and therefore, may have variations that are too numerous to mention herein.

The screen 202 has a vertical portion 402 and a horizontal portion 404. The vertical 402 and horizontal 404 portions of the screen present an "L" shape 406 as can be seen at an end view of the perspective shown in FIG. 4. Depending on the size and shape of the housing (not shown), the overall shape of the screen 202 itself may be arced or curved as shown in FIG. 4. It should be noted that such a curved shape as is shown in FIG. 4 is for example purposes only. It should be noted that the screen shape may conform to the opening (not shown) in the housing (not shown), and may vary from the particular example of a curved or arced surface as shown in FIG. 4. The screen 202 may be manufactured in any material suitable for creating the size, shape, arrangement of the perforation pattern, as well as the overall shape (such as curved or straight) of the screen for fitting an opening in the externally coupled speaker housing design. For example, the screen may be stamped or molded, metal or plastic, rigid or flexible.

The horizontal portion 404 of the screen generally protrudes, or extends approximately horizontally from the vertical portion 402. The horizontal portion 404 is configured to be retained, or held in place, between the housing and the speaker assembly (not shown in FIG. 4).

Figure 5:
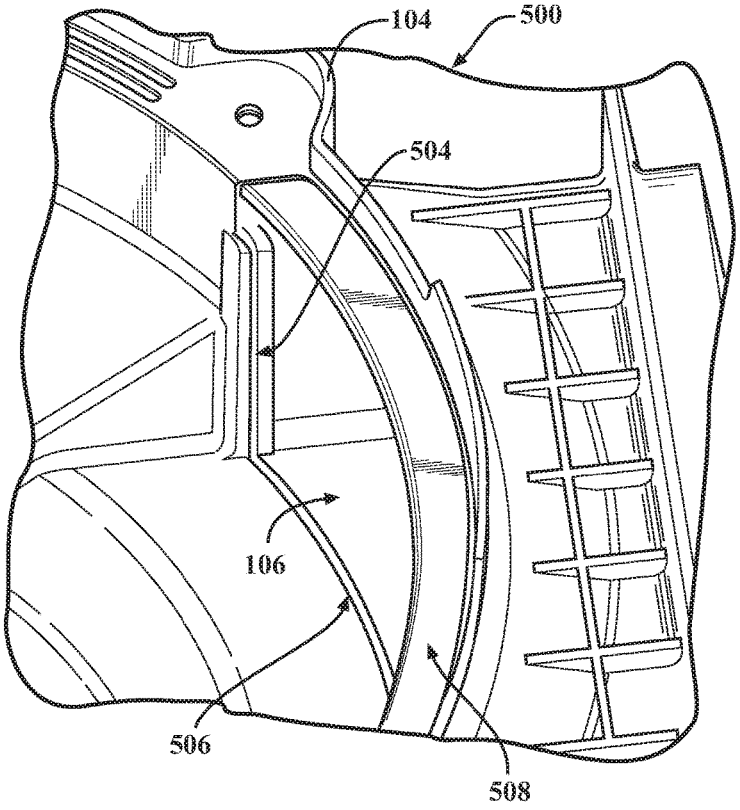
FIG. 5 is a perspective view of a section of a housing for receiving the screen.

FIG. 5 is a perspective view 500 of a detailed section of the housing 104 having a channel configured for receiving three edges of the screen (not shown in FIG. 5). The channel has a vertical channel portion 504 at each vertical side of the opening 106 (only one of which is shown in FIG. 5) and a horizontal channel 506 is configured at the bottom of the opening 106 in the housing 104 to receive a bottom edge of the screen (not shown in FIG. 5). For example, the vertical channel portions 504 and the horizontal channel portion 506 may be molded into the housing 104, or formed in another suitable manner that depends on the construction and design of the housing 104. A horizontal ledge 508 is configured at a top surface of the housing 104, at the opening 106. The horizontal ledge 508 receives the horizontal portion of the screen (not shown in FIG. 5) and may be slightly depressed from the top surface of the housing 104.

Figure 6:
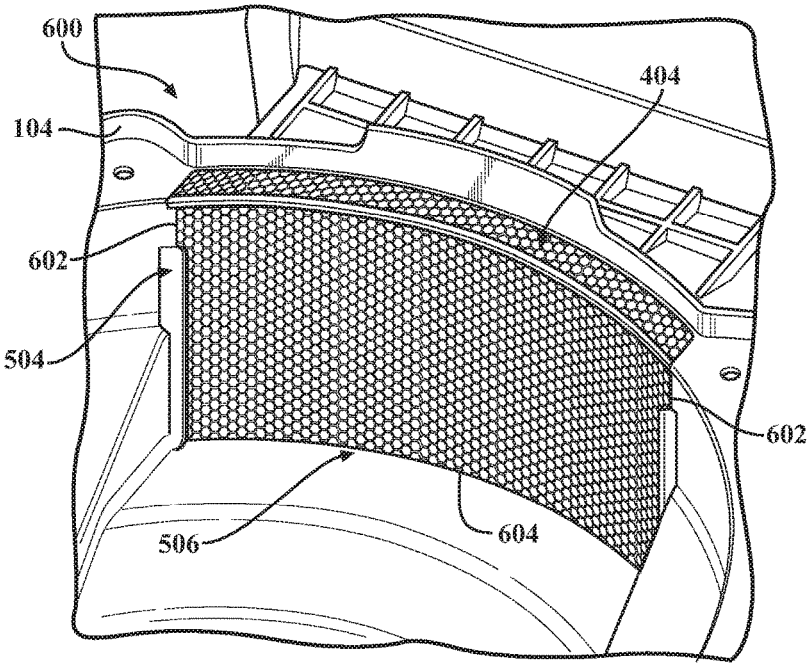
FIG. 6 is a perspective view of the screen as it is assembled to the speaker basket.
Figure 7:
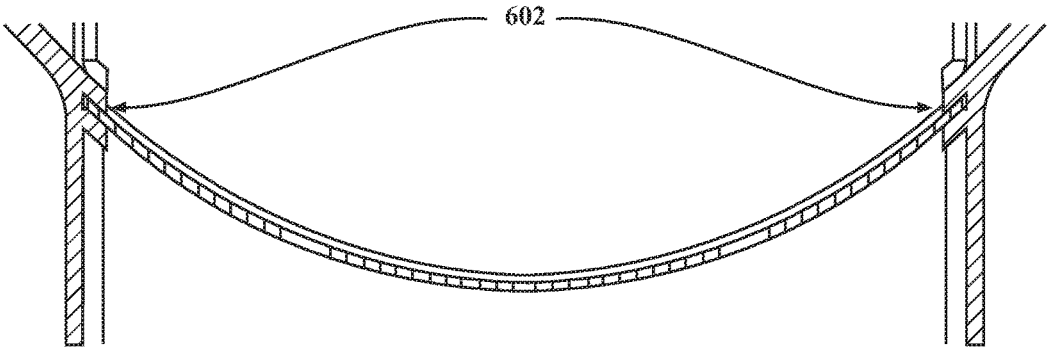
FIG. 7 is a horizontal section view of FIG. 6.

FIG. 6 is a perspective view 600 of the screen 202 as it is received in the channels 504, 506 and horizontal ledge 508 of the housing 104. The vertical edges 602 of the screen 202 are received by and held in place by the vertical channels 504 of the housing 104. A bottom edge 604 of the screen 108 is received in the horizontal channel 506 of the housing 104. The horizontal portion 404 of the screen 108 rests atop the horizontal ledge 508 of the housing 104 as shown in FIG. 5 where the screen 108 is fully positioned in the housing 104. FIG. 7 is a section view 600 taken along A-A of FIG. 5, showing the screen 108 positioned in the channels 504, 506 of the housing 104.

Figure 8:
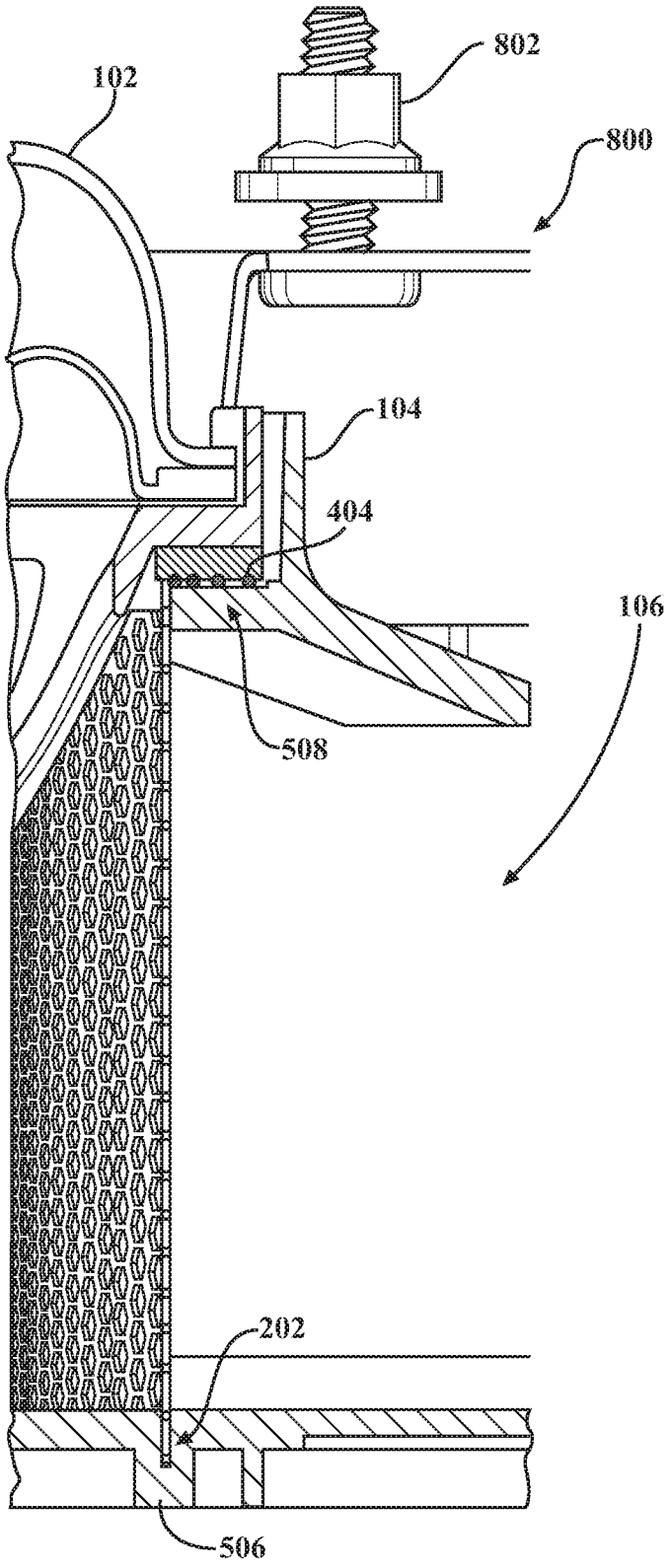
FIG. 8 is a side view section of FIG. 6.

FIG. 8 is a cutaway side view 800 of the speaker assembly showing the screen fully assembled to the speaker basket. The speaker 102 is attached by fasteners 802 to the speaker housing 104. A bottom surface of the speaker 102 holds the horizontal portion 404 of the screen 202 atop the horizontal ledge 508 of the housing 104. The horizontal portion of the screen 202 is interposed, or sandwiched, between the speaker 102 and the speaker housing 104. A top side of the horizontal portion abuts a bottom side of the speaker 102 and an underside of the horizontal portion abuts the housing 104 along the horizontal ledge 508 of the housing 104. The horizontal channel 506 of the housing 104 receives the bottom portion of the screen 202. In this manner, the screen is held in place in the opening 106 of the housing 104.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. The equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

The invention claimed is:

1. An externally coupled speaker assembly; comprising:

a speaker, a housing for receiving the speaker, the housing having an opening below the speaker, the opening in the housing extends to an area outside of the speaker assembly, wherein the speaker is externally coupled to the area outside of the speaker assembly through the opening in the housing, a channel in the housing, the channel in the housing is below the speaker and approximate to the opening in the housing below the speaker;

a horizontal ledge extending along a top side of the opening in the housing; and a screen positioned at the opening of the housing below the speaker, the screen having a vertical portion and a horizontal, portion that protrudes from the vertical portion, the vertical portion of the screen being inserted into the channel, a top side of the horizontal portion of the screen abuts a bottom side of the speaker and an underside of the horizontal portion ref the screen abuts the horizontal ledge of the housing.

2. The externally coupled speaker assembly as claimed in claim 1 wherein the screen has an overall shape that matches a shape of the opening in the housing.

3. The externally coupled speaker assembly as claimed in claim 1 wherein the channel is configured to retain the vertical portion of the screen at each vertical edge of the screen.

4. The externally coupled speaker assembly as claimed in claim 1 wherein the channel is configured to retain the vertical portion of the screen along a bottom edge of the vertical portion of the screen.

5. The externally coupled speaker assembly as claimed in claim 1, further comprising:

the horizontal portion of the screen is interposed between a n surface of a portion of the speaker and a top surface of the horizontal ledge; and the channel is configured to retain the vertical portion of the screen at each vertical edge of the screen and along a bottom edge of the screen.

6. A housing for externally coupling a speaker, the housing comprising:

an opening in the housing that extends to an area outside of the housing, the opening in the housing is below the speaker and externally couples the speaker to the area outside of the housing;

a channel at the opening in the housing, the channel is below the speaker;

a horizontal ledge extending along the housing at a top side of the opening in the housing; and a screen positioned at the opening of the housing, the screen has a vertical portion and a horizontal portion that protrudes from the vertical portion, the vertical portion of the screen is inserted into the channel, a top side of the horizontal portion of the screen abuts a bottom side of the speaker and an underside of the horizontal portion of the screen abuts the horizontal ledge of the housing.

7. The housing as claimed in claim 6 wherein the screen has an overall shape that matches a shape of the opening in the housing.

8. The housing as claimed in claim 6 wherein the channel is configured to retain the vertical portion of the screen at each vertical edge of the screen.

9. The housing as claimed in claim 6 wherein the channel is configured to retain the screen along a bottom edge of the screen.

10. The housing as claimed in claim 6 further comprising:

the horizontal portion of the screen is interposed between a bottom surface of a portion of the speaker and a top surface of the horizontal ledge; and the channel is configured to receive the vertical portion of the screen at each vertical edge of the screen and along a bottom edge of the vertical portion of the screen.

11. A screen for a speaker assembly having a speaker and a housing for the speaker, the housing has an opening therein, the opening in the housing is below the speaker and externally couples the speaker to an area outside of the housing, the screen comprising:

a vertical portion of the screen is inserted into a channel of the housing, the channel is positioned near the opening of the housing below the speaker; and a horizontal portion of the screen that protrudes from the vertical portion, a top surface of the horizontal portion of the screen abuts an underside of the speaker and a bottom surface of the horizontal portion of the screen abuts the housing.

12. The screen as claimed in claim 11 wherein an overall shape of the screen matches the opening in the housing.

13. The screen as claimed in claim 11 wherein the vertical portion of the screen is inserted into the channel of the housing at each vertical edge of the vertical portion.

14. The screen as claimed in claim 11 wherein the vertical portion of the screen is inserted into the channel of the housing along a bottom edge of the vertical portion.

15. The screen as claimed in claim 11 wherein the vertical portion of the screen is inserted into the channel of the housing at each vertical edge and along a bottom edge of the vertical portion.

16. The screen as claimed in claim 11 further comprising:

the vertical portion of the screen is retained in the housing at each vertical edge and along a bottom edge of the vertical portion; and the horizontal portion has a top surface and a bottom surface, the top surface of the horizontal portion abuts a bottom surface of the speaker and a bottom surface of the horizontal portion abuts a top surface of the housing.

* * * * *